United States Patent [19]

Salomon

[11] 3,942,810

[45] Mar. 9, 1976

[54] SAFETY FIXING DEVICE FOR SKIS

[75] Inventor: Georges Pierre Joseph Salomon, Annecy, France

[73] Assignee: S.A. Establissements Francois Salomon & Fils, Annecy, France

[22] Filed: Jan. 18, 1974

[21] Appl. No.: 434,543

[30] Foreign Application Priority Data

Jan. 19, 1973 France ..... 73.01867

[52] U.S. Cl. ..... 280/11.35 K; 280/11.35 R

[51] Int. Cl.[2] ..... A63C 9/08

[58] Field of Search 280/11.35 K, 11.35 Y, 11.35 E, 280/11.35 D, 11.35 A, 11.35 R, 11.35 C, 11.35 H, 11.35 T; 9/310 AA

[56] References Cited

UNITED STATES PATENTS

| | | | |
|---|---|---|---|
| 2,693,967 | 11/1954 | Jones, Jr. | 280/11.35 A |
| 3,206,221 | 9/1965 | Schneider | 280/11.35 K |
| 3,672,694 | 6/1972 | Whittaker | 280/11.35 K |
| 3,730,543 | 5/1973 | Edmund | 280/11.35 T |
| 3,741,576 | 6/1973 | Salomon | 280/11.35 H |
| 3,845,964 | 11/1974 | Johnson | 280/11.35 K |

*Primary Examiner*—Robert R. Song
*Assistant Examiner*—Milton L. Smith

[57] ABSTRACT

A safety fixing device for skis permitting automatic recentering of the ski boot on the longitudinal axis of the ski when fixing said device on the skier's feet while standing up, said device comprising a member adapted to retain one of the extremities of said boot and including a first ramp associated with said boot and a second ramp located on a catch member fixed on said ski, said catch having a portion which is movable between two positions, a first position in which the moving portion of said catch is raised with respect to the ski and a second position in which the moving portion of said catch is locked with respect to said ski, the transition from said first to said second position by the action of pressure of the boot being effected against the force of an elastic member by compressing this latter, the profile of the two ramps in a plane parallel to the ski and to the sole of the boot having substantially the forms of a concave and a convex curve opening out towards the same extremity of the ski, the ramp associated with said boot comprising at least one projecting portion and two sliding surfaces, one said surface being substantially parallel to the boot and directed downwards, the other being inclined with respect to said boot and directed upwards, the ramp located on the moving portion of said catch comprising at least one projecting portion, the ramps associated with the boot and the moving portion of said catch cooperating in such manner that the pivotal movement of the catch causes at least one of the projecting portions of the ramp of said catch to slide over the downwardly-directed sliding surface, while the projecting portion of the ramp associated with said boot slides over the ramp located on the moving portion of said catch.

15 Claims, 7 Drawing Figures

SAFETY FIXING DEVICE FOR SKIS

The present invention relates to safety fixing devices for skis, in which the boot is temporarily or permanently fixed to a member added or directly obtained by molding, intended to co-operate by means of a ramp with a homologous retaining member fixed to the ski, in particular a pivoted catch.

This type of fixing with a member molded or added to the boot has, by reason of its structure, a certain number of problems, especially during the putting on of skis, especially in the case where the said molded or added member has dimensions less than those of the boot sole - and are thus concealed from the skier's view - this member requiring nevertheless to be engaged with a maximum of accuracy in the retention member fixed on the ski.

With known devices, this represents a delicate operation necessitating a certain skill on the part of the skier on the one hand, and on the other hand, a checking of the correct placing in position of the boot.

In the known devices, the extremity of the boot, co-operating with a hinged catch fixed on the ski, has an inclined profile in the shape of a wedge, the catch having in horizontal section substantially the shape of a U. In particular, in a known alternative form of construction, the profile of the ramp associated with the boot is constituted by one or more frusto-conical studs applied against inclined planes of the catch which has an arcuate form in horizontal section.

These constructions have the disadvantage either of not permitting sufficient guiding when putting on the skis, or of necessitating a considerable effort in order to overcome the friction forces between the added members and the skis. In fact, in these known constructions, centering can only be effected when the molded or added member is in contact with the ski, since the catch is fixed with respect to the ski.

In order to comply with conditions of safety and convenience of use, the co-operating ramps must ensure, in addition to the retention of the boot, its correct positioning with respect to the axis of the ski when putting on the latter, and this is true even in the case where the user presents his boot laterally inclined with respect to the ski. It is therefore essential to provide a guiding action between the ramps of the boot and the ski in order to achieve this correct positioning.

The present invention proposes a new structure for the profiles in contact with these ramps which permits automatic re-centering of the boot along the longitudinal axis of the ski during the engagement of the foot-fixing device, in the upright position.

The invention is a combination of three essential arrangements which co-operate with each other in such manner that, when putting on the skis:

- the boot is automatically re-oriented into the longitudinal axis of the ski;
- the friction forces are reduced to a minimum;
- the skier can use the weight of his body to overcome the friction forces.

To this end, according to a first arrangement of the invention, the catch member comprises a portion which is movable between two positions:

- A first position in which the moving part of the catch member is raised with respect to the ski;
- a second position in which the moving part of the catch member is locked with respect to the ski;
- the passage from the first to the second position, by the action of the boot, being effected against the action of an elastic member, by compressing it.

According to a second arrangement, the profiles of the two ramps seen in cross section following a plane parallel to the ski or to the boot, have the shape of a concave and a convex curve and open out towards one single extremity of the ski. The section of these ramps in a vertical plane is inclined with respect to the ski towards the same extremity of this latter.

According to a third arrangement of the invention:

- the ramp associated with the boot comprises at least one projecting portion and two sliding surfaces, one substantially parallel to the boot and directed downwards; the other inclined with respect to the boot and directed upwards; and
- the ramp located on the catch member is mounted on the moving portion of the catch and comprises projecting portions.

The ramps associated with the boot and located on the moving portion of the catch member co-operate in such manner that when the moving portion of the catch pivots under the action of the boot, when putting on the skis:

- the projecting part or parts of the ramp of the moving catch slide over the sliding surfaces directed downwards; and
- the projecting portion of the ramp of the boot slides over the ramp mounted on the moving part of the catch member.

By virtue of this combination of means, the friction forces are reduced to a minimum. In fact, the contacts between the projecting parts and the sliding surfaces are substantially at points, so that the supporting surfaces are of very small dimensions.

Furthermore, the movement of the projecting portions on the sliding surfaces is the component of two movements:

- a movement of lateral translation corresponding to the re-centering of the boot along the longitudinal axis of the ski; and
- a movement of vertical translation corresponding to the pivotal movement of the catch and the boot towards the ski.

When putting on the ski, the skier uses the weight of his body to cause the catch to pivot, so that he easily overcomes the friction forces opposing the pivotal movement of the catch. Now, according to a well known principle of the mechanics of members under friction, it is known that if the friction is overcome in one direction, it is also overcome in all the other directions and therefore, especially in the present case, the friction forces are eliminated in the direction in which the friction forces oppose the re-centering of the boot.

Finally, the concave and convex forms given to the sliding surfaces and their inclination contribute in an essential manner to the re-centering of the boot by guiding the movement of the projecting portions fixed to the ramp of the boot.

According to an auxiliary feature of the invention, corresponding to a preferred form of embodiment:

- The profile of the ramp of the boot in a plane parallel to the boot has substantially the shape of a V, the axis of symmetry of which is that of the boot; and
- the profile of the ramp of the moving portion of the catch, in a plane parallel to the ski, has substantially the shape of an M, the axis of symmetry of which is the axis of the ski.

In addition, according to a further characteristic feature corresponding to this same preferred form of embodiment:

- the projecting portions of the ramp of the moving catch are constituted by the projecting angles located on each side of the M-shaped ramp;
- the sliding surface orientated downwards is located above the inclined sliding surface;
- the projecting portion of the ramp of the boot is located at the extremity of the intersection edge of the two inclined surfaces forming a V; and
- the V and M shaped ramps flare outwardly towards the boot.

Furthermore, according to another additional characteristic corresponding to another alternative form of this preferred embodiment:

- the projecting portions of the ramp of the moving catch are located at the lower part and on each side of the M-shaped ramp, extending towards the boot;
- the sliding surface orientated downwards is located below the inclined sliding surface;
- the projecting portion of the ramp of the boot is located at the extremity of the intersection edge of the two inclined surfaces forming a V; and
- the V and M-shaped ramps are flared outwards towards the boot.

According to another auxiliary feature of the invention, corresponding to another form of construction of a fixing device according to the invention:

- the profile of the ramp of the boot, in a plane parallel to the boot, has substantially the form of an M, the axis of symmetry of which is the longitudinal axis of the ski; and
- the profile of the ramp of the moving part of the catch, in a plane parallel to the ski, has substantially the form of a V, the axis of symmetry of which is the longitudinal axis of the ski.

In addition, according to a complementary characteristic feature corresponding to this latter alternative construction:

- the projecting portion of the ramp of the moving catch is located at the extremity of the intersection edge of the inclined suafeces forming a V;
- the sliding surface directed downwards is located above the inclined sliding surface; and
- the projecting portion of the ramp of the boot is constituted by one of the angular projections located on each side of the M-shaped ramp.

All these alternative forms of construction differ in the number and the relative positions of the projecting portions of the sliding surfaces directed downwards, and the inclined sliding surfaces, but it is clear that they are all derived from the general principles previously stated.

Finally, it is emphasized that the ramp associated with the boot may be mounted permanently on this latter or on the contrary, it may be fixed on a member added in a removable manner to the boot. Similarly, the surfaces of these ramps may be flat or skewed.

There will now be described a few non-limitative examples of construction of a fixing device according to the invention, reference being made to the accompanying drawings, in which.

Figure 6A:
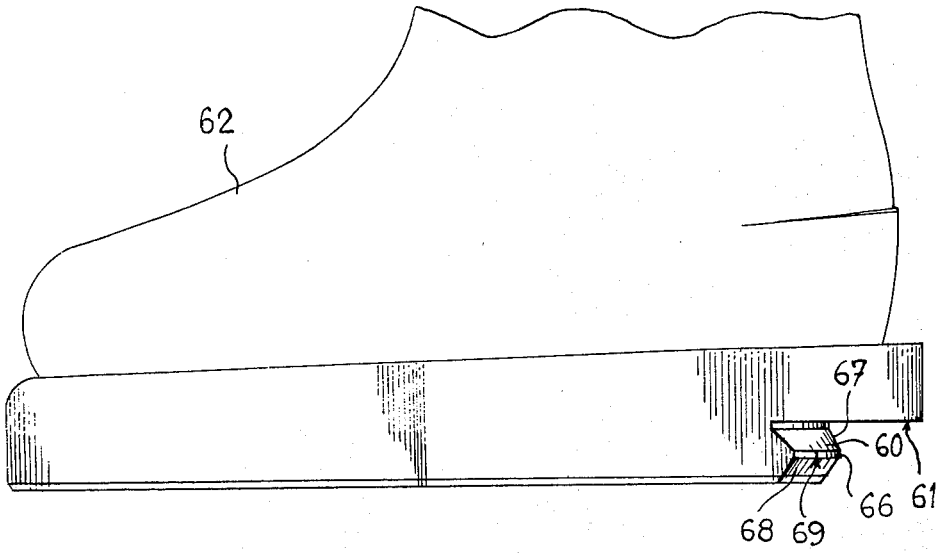
Figure 6B:
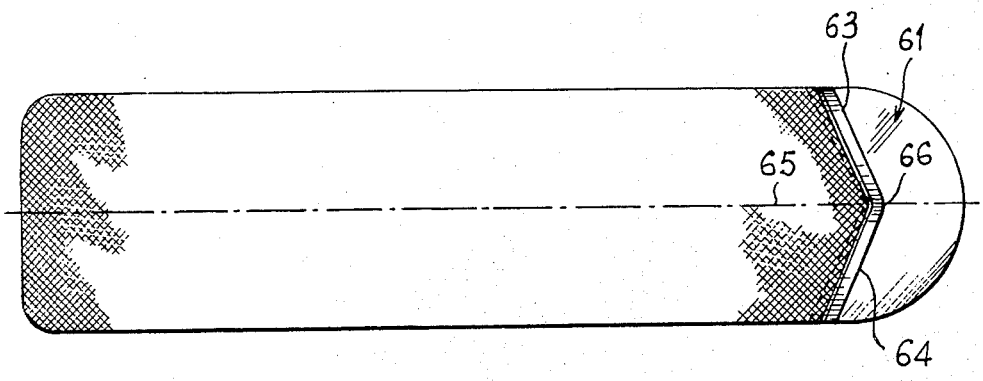

FIG. 6*a* is a side view of a boot comprising a permanent ramp according to the invention; and FIG. 6*b* is a view of the underside of the boot shown in FIG. 6*a*.

Figure 1:
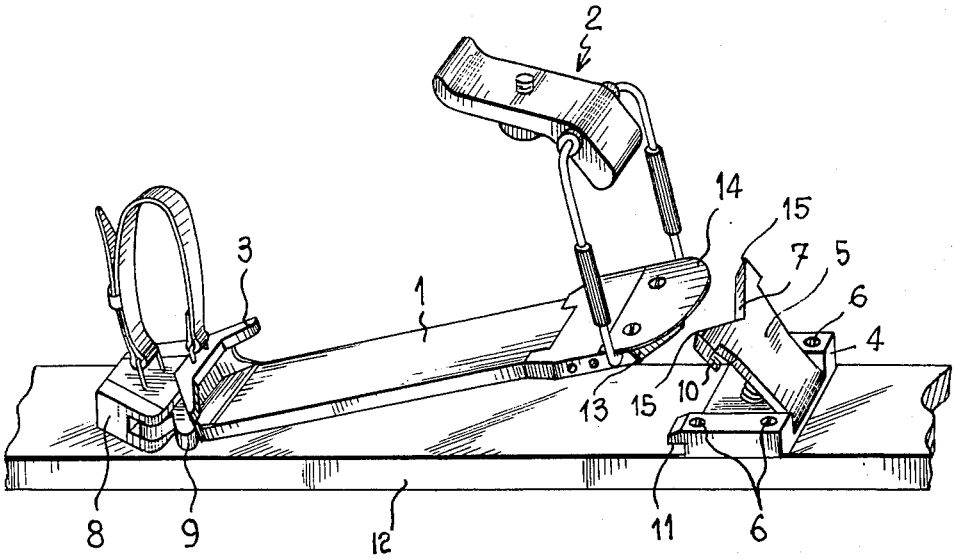
FIG. 1 shows a general perspective view of a fixing device of the type comprising a member added to the sole of the boot and comprising a catch member having a moving part.

FIG. 1 represents a perspective view of a fixing device of a type comprising a member added to the sole of the boot in the position with skis removed, the boot not having been shown for the sake of clearness.

The fixing device is of the plate type, the plate 1 being temporarily fixed in known manner to the boot by means of the elements 2 and 3. The catch member comprises a fixed portion 4 and a moving portion 5. The fixed portion 4 of the catch is fixed to the ski 12 by means of screws 6. The moving portion 5, on which the ramp 7 is located is pivoted and movable in translation with respect to the fixed portion 4 of the catch, in particular about an axial pivot fixed on this portion of the catch. The extremity 3 of the plate 1 is in abutment against a stop 8 comprising two lateral levers 9 actuated by the boot against the action of an elastic member located in the interior of the stop.

The stop, in the example of construction shown in FIG. 1, is located at the front of the boot, but it could be formed in any other manner. In particular, in an alternative form of embodiment of the invention, this stop is fixed and the elastic member is mounted between the ski and the fixed portion 4 of the catch, this latter portion being obviously in this case movable in longitudinal translation with respect to the ski. In this latter alternative form of construction, the lateral release is obtained, either by means of the front stop if this latter is pivotally mounted for rotation, or by means of the catch if it is this latter which is pivotally mounted for rotation.

A system of ramps (which will be described with reference to FIG. 2) respectively fixed on the fixed portion 4 of the catch and on the rear extremity of the moving portion 5 of the catch guides the movement of rotation and longitudinal translation of the moving portion of the catch, so that this latter moves backward, when it is substantially forced down, under the action of the elastic member of the front stop which pushes the boot towards the rear.

In the down position, after longitudinal translation, the bent back extremity 10, located at the front of the moving portion of the catch, becomes engaged under a nose 11 fast on the fixed portion of the catch, so that in this position, the moving portion of the catch is locked with respect to the ski.

The ramp 13, located at the rear extremity of the plate, co-operates with the ramp 7 of the catch by becoming engaged under this latter by the action of the skier. In order to lower the moving part of the catch, the skier applies the rear extremity 14 of the plate 1 fixed to the boot against the projecting portions 15 fixed to the moving portion of the catch. It will be specified with reference to FIGS. 2, 3, 4 and 5 in what manner the ramp 13 fixed to the rear extremity of the plate 1 and the projecting portions 15 fixed to the catch co-operate with each other.

Figure 2:
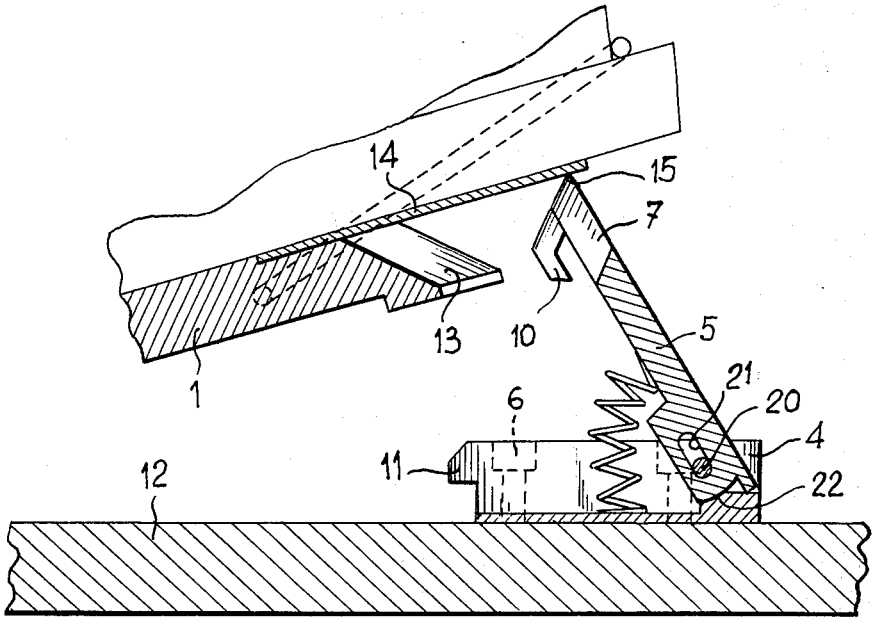
FIG. 2 is a detail view in longitudinal section of the fixing device shown in FIG. 1 in the position for putting on the skis.

FIG. 2 is a view in vertical section taken along the longitudinal plane of symmetry of the ski, of the fixed and moving portions of the catch member. There are again seen the greater part of the members described with reference to FIG. 1, especially the moving part 5 of the catch on which are located the ramp 7 and the projecting portions 15. The fixed portion 4 of the catch is secured to the ski 12 by means of screws 6.

The moving portion of the catch is movable in translation and in rotation with respect to the fixed portion, about a shaft 20 fast with the fixed portion of the catch. A system of ports 21 and ramps 22 permits the guiding of the combined movement of rotation and translation of the moving portion 5 of the catch, so that the latter cannot move back before it is substantially in its bottom position.

In his U.S. Pat. application Ser. No. 374,623, filed on June 28, 1973 for "A safety fixing device for putting on a ski boot", the Applicant has described other alternative forms of these systems of ports and ramps intended to guide the combined movement of rotation and translation of the moving portion of a catch member for locking on the ski in the down position.

Figure 3:
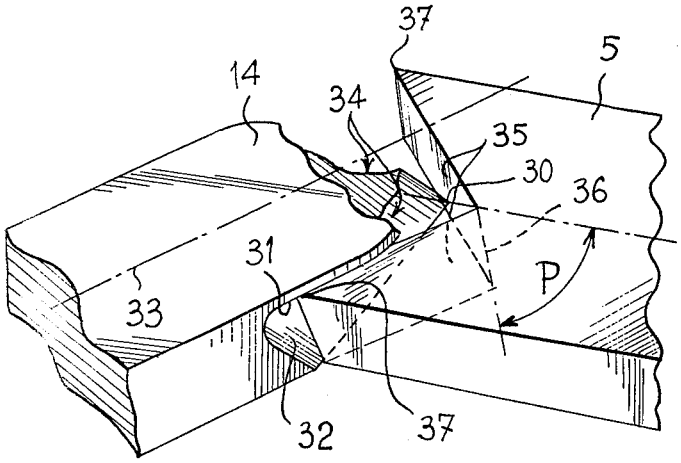
FIG. 3 is a detail view in perspective of a first alternative form of construction of the system of ramps according to the invention.

FIG. 3 is a detail view in perspective with parts broken away, of an alternative form of the system of ramps and projecting portions located respectively at the extremity of the moving portion of the catch and at the extremity of the boot. There is again seen the extremity 14 of the plate fixed on the boot and the extremity of the moving portion 5 of the catch (the bent-back nose 10 fixed on the front extremity of the moving portion of the catch and intended to lock this latter on the ski has not been shown).

The ramp mounted on the boot comprises a projecting portion 30 and two sliding surfaces, of which one 31 is substantially parallel to the boot and directed downwards, while the other 32 is inclined with respect to the boot and is directed upwards. This latter is constituted by two flat surfaces 34 arranged symmetrically with respect to the longitudinal axis 33 of the boot. The profile of this ramp, seen in cross-section in a plane parallel to the plane of the boot has substantially the shape of a V, the axis of symmetry is that 33 of the boot.

The projecting portion 30 of this ramp is constituted by the rear extremity of the intersection edge of the flat inclined surfaces 34.

The ramp located on the moving catch is constituted by two flat inclined surfaces 35, the intersection edge 36 of which is located in the longitudinal plane of symmetry of the ski. The profile of this ramp seen in section in a plane parallel to the plane of the ski (when the moving catch is in its lowered position) has substantially the form of an M, the axis of symmetry of which is the longitudinal axis of the ski. The moving portion of the catch comprises two projecting portions 37 constituted by the angular projections located on each side of the M-shaped ramp.

The sliding surfaces and the projecting portions co-operate in such manner that, when the catch rotates:

- the projecting portions 37 of the ramp of the moving catch slide over the sliding surface 31 directed downwards; and
- the projecting portion 30 of the ramp mounted on the boot slides over the sliding surfaces 35 located on the moving portion of the catch in the direction of the intersection edge 36 located in the longitudinal plane of symmetry of the ski.

Speaking generally, the profile of the ramp fixed on the moving catch is in the section a concave line having for its plane of symmetry the longitudinal plane of symmetry of the ski, so that the projecting portion 30 of the ramp mounted on the boot slides in the direction of this plane of symmetry P.

It is emphasized that the ramps and the projecting portions of the moving portion of the catch and of the boot are in contact at three points, so that the boot is perfectly guided and its movement in the direction of the longitudinal plane of symmetry of the ski is defined without any degree of freedom. In confirmation of this, it will be noted that the trajectories of the projecting portions 37 and 30 on the sliding surfaces 35 and 31 are constantly the same and can be recognized by shiny marks due to the polishing of the metal forming the sliding surfaces by the projecting portions, the point of which is rounded.

In addition, it will be noted that the plane of symmetry of the boot is necessarily perpendicular to the plane of the ski since the sliding surface directed downwards is substantially parallel to the plane of the boot. There results from this a considerable degree of comfort for the skier when putting on his skis, since his foot has no tendency to place itself slantwise with respect to the ski.

Figure 4:
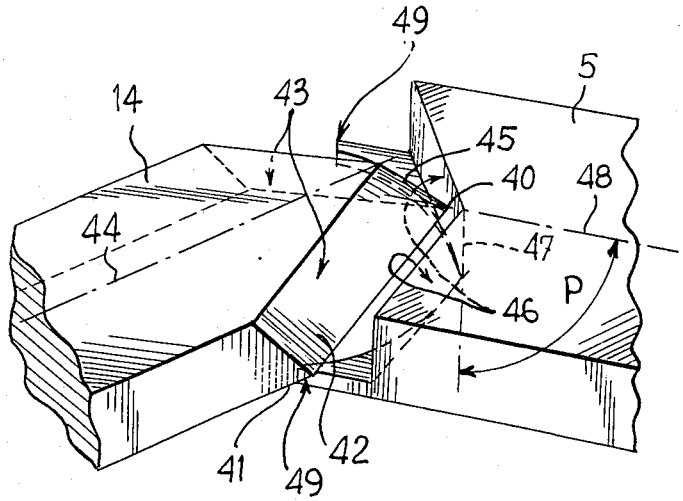
FIG. 4 is a detail view in perspective of a second alternative construction of the system of ramps in accordance with the invention.

FIG. 4 is a detail view in perspective with parts broken away, of a second alternative form of the system of sliding ramps and projecting portions. There is recognized the extremity 14 of the plate 40 fixed on the boot and the extremity of the moving portion 5 of the catch (the nose 10 permitting the locking of the moving portion of the catch on the ski has not been shown).

The ramp mounted on the boot comprises a projecting portion 40 and two sliding surfaces 41 and 42, of which one 41, is substantially parallel to the boot and directed downwards, while the other 42 is inclined with respect to the boot and directed upwards, and is constituted, in the same way as in the previous example of construction, by two flat surfaces 43 arranged symmetrically with respect to the longitudinal axis 44 of the boot.

The profile of this ramp seen in cross-section in a plane parallel to the plane of the boot has substantially the shape of a V, of which the axis of symmetry 44 is that of the boot. The projecting portion 40 of this ramp is constituted by the extremity of the intersection edge 45 of the inclined flat surfaces 43.

The ramp located on the moving catch is formed by two flat inclined surfaces 46 of which the intersection edge 47 is located in the longitudinal plane of symmetry P.

The profile of this ramp seen in cross-section in a plane parallel to the plane of the ski (when the moving catch is in its bottom position) has substantially the shape of an M, the axis of symmetry of which is the longitudinal axis 48 of the ski.

The moving portion of the catch comprises two projecting portions 49 formed by extensions located on each side of the M-shaped ramp. The sliding surfaces and the projecting portions co-operate in such manner that, when the catch pivots:

At least one of the projecting portions 49 of the ramp of the moving catch slides over the sliding surface 41 directed downwards and fixed on the plate fast with the boot; and the projecting portion 40 of the ramp mounted on the boot slides over the sliding surface 46 mounted on the moving portion of the catch, in the direction of the intersection edge 47 located in the longitudinal plane of symmetry of the ski and downwards.

Figure 5:
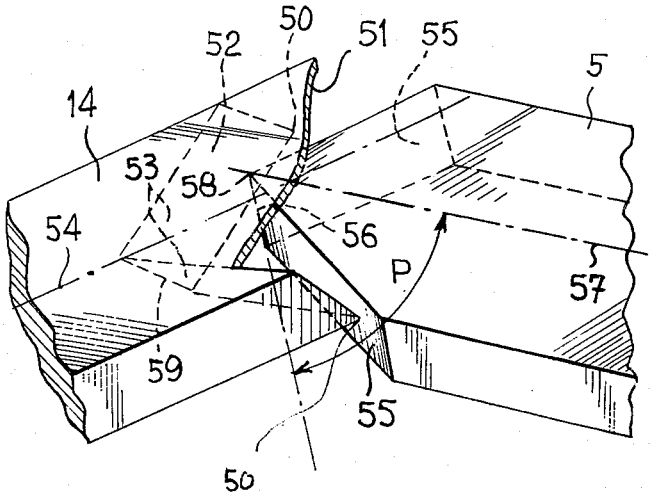
FIG. 5 is a detail view in perspective of a third alternative form of construction of the system of ramps according to the invention.

FIG. 5 is a detail view in perspective with parts broken away of another alternative form of the system of sliding ramps and projecting portions.

There will again be seen the extremity 14 of the plate fixed on the boot and the extremity of the moving portion 5 of the catch (the nose 10 permitting the locking of the moving portion of the catch on the ski has not been shown). The ramp mounted on the boot comprises a projecting portion 50 and two sliding surfaces 51 and 52, of which one 51 is parallel to the boot and directed downwards, while the other, 52, is inclined with respect to the boot and directed upwards, and is constituted by two flat surfaces 53 arranged symmetrically with respect to the longitudinal axis 54 of the boot.

The profile of this ramp seen in cross-section in a plane parallel to the plane of the boot has substantially the form of an M, the axis of symmetry of which is that of the boot. The projecting portion of this ramp is constituted by one or the other of the angular projections located on each side of the M-shaped ramp.

The ramp situated on the moving catch is constituted by two flat inclined surfaces 55, the intersection edge 56 of which is located in the longitudinal plane of symmetry P of the ski. The profile of this ramp seen in section in a plane parallel to the plane of the ski (when the moving catch is in its bottom position) has substantially the form of a V in which the axis of symmetry 57 is the longitudinal axis of the ski in the bottom position.

The moving portion of the catch comprises a projecting portion 58 constituted by the front extremity of the intersection edge 56 of the two flat inclined surfaces 55, directed downwards.

The sliding surfaces and the projecting portions cooperate in such manner that, when the catch pivots:

The projecting portion 50 of the ramp mounted on the boot slides over the sliding surface 55 mounted on the moving portion of the catch;

the sliding surface 51 of the ramp fixed on the boot slides over the projecting portion 58 of the ramp of the moving catch in a direction such that the vertical plane of symmetry of the boot comes into coincidence with the longitudinal plane of symmetry of the ski.

FIGS. 6*a* and 6*b* represent respectively a side view and a view of the underside of the boot comprising permanently a system of ramps according to the invention. The ramp is of the same type as that shown in FIG. 3.

There will be recognized the two sliding surfaces 60 and 61, of which one, 61, is substantially parallel to the boot 62 and is located under the skier's heel; the other, 60, is inclined with respect to the boot and directed upwards, and is constituted by two substantially flat surfaces 63 and 64 arranged symmetrically with respect to the longitudinal axis 65 of the boot. The profile of the inclined sliding surface 60, when looking from below, has substantially the form of a V in which the axis of symmetry 65 is the same as that of the boot.

The projecting portion of this ramp, as in the case of the alternative construction shown in FIG. 3, is constituted by the extremity 66 of the intersection edge 67 and of the two inclined flat surfaces 63 and 64. In the case of this alternative form of construction, the surfaces are directly machined in the thickness of the sole of the boot, made of appropriate material and having the mechanical characteristics necessary for this use (low rate of wear, resistance to deformation, etc.). The sliding surfaces may also be obtained directly by molding during the manufacture of the boot and of the sole. It is also conceivable to produce the sliding surface 60 and 61 of metal and to assemble them on the sole of the boot by any appropriate assembly means, in particular by sticking, screwing, etc.

The base of this ramp terminates in a bead 68 having the purpose of preventing damage to the vertical release nose 69 and the projecting portion 66 during incidental walking on stony ground.

The invention is not limited to the examples of construction illustrated and described in detail, since various modifications may be made thereto without thereby departing from its scope.

What I claim is:

1. A safety fixing device for skis permitting automatic re-centering of the boot on the longitudinal axis of the ski when the skier fixes said device on the feet while standing up, said device including a member for retaining one of the extremities of said boot, comprising:

a first ramp mounted on said boot, a catch member mounted on said ski comprising a mobile portion on which is located a second ramp; said mobile portion moving between two positions, a first position in which the mobile portion of said catch member is raised with respect to said ski, a second position in which the mobile portion of said catch member is locked with respect to the ski;

the transition from said first to said second position being effected by the action of the boot against the action of an elastic member located in said fixing device at least at one end of the extremities of the boot, the profile of said two ramps in a plane parallel to the ski and to the sole of said boot having substantially the form of a concave curve and a convex curve opening out towards the same extremity of said ski;

said ramp mounted on said boot comprising at least one projecting portion and two sliding surfaces, one said surface being substantially parallel to said boot and directed downwards, the other being inclined with respect to said boot and directed upwards;

the ramp located on the mobile portion of said catch member comprising at least one projecting portion, the ramp associated with the boot and the ramp of the mobile portion of said catch member cooperating in such manner that when said mobile portion rotates:

the projecting portion of the ramp of said mobile portion slides over the sliding surface directed downwards;

the projecting portion of the ramp associated with said boot slides over the ramp located on the mobile portion of said catch member.

2. A fixing device as claimed in claim 1, in which the profile of the first ramp mounted on said boot in a plane parallel to said boot has substantially the shape of a V, the axis of symmetry of which is the same as that of the boot; the profile of the ramp of the mobile portion of said catch in a plane parallel to the ski having substantially the shape of an M, of which the axis of symmetry is the axis of said ski.

3. A fixing device as claimed in claim 2, in which the projecting portions of the ramp of said mobile portion are constituted by the angular projections located on each side of said M-shaped ramp, the projecting portion of the ramp of said boot is located at the extremity of the intersection edge of the two inclined surfaces forming a V, the V and the M-shaped ramps being outwardly-flared towards the boot, while the sliding surface directed downwards is located above the inclined sliding surface.

4. A fixing device as claimed in claim 2, in which the projecting portions of the ramp of said mobile portion are located at the lower part and on each side of said M-shaped ramp, extending towards the boot, the projecting portion of the ramp of the boot is located at the extremity of the intersection edge of said two inclined surfaces forming a V, the sliding surface directed downwards being located below said inside sliding surface and the V and M-shaped ramps flaring outwardly towards the boot.

5. A fixing device as claimed in claim 1, in which the profile of the ramp of said boot in a plane parallel to the boot has substantially the shape of an M, the axis of symmetry of which is the longitudinal axis of said boot; the profile of the ramp of the mobile portion of said catch member in a plane parallel to the ski having substantially the shape of a V, the axis of symmetry of which is the longitudinal axis of said ski.

6. A fixing device as claimed in claim 5, in which the projecting portion of the ramp of said mobile portion is located at the extremity of the intersection edge of said inclined surfaces forming a V; the projecting portion of the ramp of the boot is constituted by one of the angular projections located on each side of said M-shaped ramp; and the sliding surface directed downwards is located above said inclined sliding surface.

7. A fixing device as claimed in claim 1, in which the ramp mounted on said boot is rigidly fixed on a member added in a removable manner on said boot.

8. A fixing device as claimed in claim 3, in which the lower part of said upwardly-directed inclined sliding surface is provided with a bead adapted to prevent damage to the lower edge of said sliding surface when walking over stony ground.

9. A ski boot of the kind in which at least one of the extremities of said boot comprises in a recess, under the sole of the boot and above the surface of the sole touching the ground, a ramp; said ramp being provided with at least one projecting portion and two sliding surfaces, one of said surfaces being substantially parallel to said boot and directed downwards while the other said surface located below said one surface is inclined with respect to said boot and is directed upwards.

10. A ski boot as claimed in claim 9, in which the profile of said ramp in a plane parallel to said boot has substantially the shape of a V, the axis of symmetry of which is the same as that of said boot.

11. A ski boot as claimed in claim 10, in which the projecting portion of the ramp of said boot is located at the extremity of the intersection edge of said two surfaces inclined in the form of a V.

12. A ski boot as claimed in claim 9, in which the profile of said ramp in a plane parallel to said boot has substantially the shape of an M, the axis of symmetry of which is that of said boot.

13. A ski boot as claimed in claim 12, in which the projecting portions of the ramp of said boot are constituted by the angular projections located on each side of said M-shaped ramp.

14. A ski boot as claimed in claim 9, wherein said other surface is located below the sliding surface substantially parallel to said boot.

15. A ski boot of the kind in which at least one of the extremities of said boot comprises a ramp located under the sole of the boot; said ramp being provided with at least one projecting portion and two sliding surfaces, one of said surfaces being substantially parallel to said boot and directed downwards while the other said surface is inclined with respect to said boot and is directed upwards; said upwardly-directed inclined sliding surface being provided with a bead connecting the inclined sliding surface with the surface of the sole touching the ground.

* * * * *